US006682868B1

(12) United States Patent
Dickerson et al.

(10) Patent No.: US 6,682,868 B1
(45) Date of Patent: Jan. 27, 2004

(54) RADIOGRAPHIC IMAGING ASSEMBLY WITH BLUE-SENSITIVE FILM

(75) Inventors: Robert E. Dickerson, Hamlin, NY (US); Richard F. Davis, Rochester, NY (US); David J. Steklenski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/397,567

(22) Filed: Mar. 26, 2003

(51) Int. Cl.[7] ..... G03C 5/17; G03C 1/015; G03C 1/047; G03C 1/46

(52) U.S. Cl. ..... 430/139; 430/502; 430/567; 430/642; 430/966; 430/967

(58) Field of Search ..... 430/139, 434, 430/567, 569, 642, 502, 966, 967

(56) References Cited

U.S. PATENT DOCUMENTS

| | | | | | |
|---|---|---|---|---|---|
| 3,591,379 | A | | 7/1971 | Plakunov | |
| 3,708,302 | A | | 1/1973 | Plakunov et al. | |
| 3,848,133 | A | | 11/1974 | Blanc et al. | |
| 4,130,428 | A | | 12/1978 | Van Doorselaer | |
| 4,130,429 | A | | 12/1978 | Van Doorselaer | |
| 4,425,425 | A | * | 1/1984 | Abbott et al. | 430/502 |
| 4,425,426 | A | * | 1/1984 | Abbott et al. | 430/502 |
| 4,518,689 | A | | 5/1985 | Noguchi et al. | |
| 4,665,012 | A | | 5/1987 | Sugimoto et al. | |
| 4,713,320 | A | * | 12/1987 | Maskasky | 430/567 |
| 4,801,526 | A | | 1/1989 | Yoshida et al. | |
| 4,835,397 | A | | 5/1989 | Arakawa et al. | |
| 5,087,555 | A | | 2/1992 | Saitou | |
| 5,219,720 | A | * | 6/1993 | Black et al. | 430/567 |
| 5,318,888 | A | | 6/1994 | Weberg et al. | |
| 5,381,015 | A | | 1/1995 | Dooms | |
| 5,464,568 | A | | 11/1995 | Bringley et al. | |
| 5,595,864 | A | | 1/1997 | Van den Zegel et al. | |
| 5,629,142 | A | * | 5/1997 | Maskasky | 430/502 |
| 5,650,266 | A | | 7/1997 | Taguchi et al. | |
| 6,087,085 | A | | 7/2000 | Elst | |
| 6,348,293 | B1 | * | 2/2002 | Verbeeck et al. | 430/502 |
| 6,350,554 | B1 | * | 2/2002 | Dickerson et al. | 430/502 |

FOREIGN PATENT DOCUMENTS

| | | |
|---|---|---|
| EP | 0 712 034 B1 | 4/2002 |

OTHER PUBLICATIONS

USSN 10/397,691(D–85620) Davis et al., titled *Blue–Sensitive Film For Radiography and Imaging Assembly and Method* filed on even date herewith.

* cited by examiner

*Primary Examiner*—Richard L. Schilling
(74) *Attorney, Agent, or Firm*—J. Lanny Tucker

(57) ABSTRACT

An imaging assembly includes a blue-sensitive, radiographic silver halide film comprises a silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide. The tabular silver halide grains are dispersed in a hydrophilic polymeric vehicle mixture comprising at least 0.5% of oxidized gelatin. The film is used in combination with one or more intensifying screens that absorb X-radiation and emit radiation having a wavelength of from about 300 to about 500 nm. In many embodiments, the intensifying screens include a "blue-light" emitting alkaline earth fluorohalide phosphor dispersed in a binder on a support.

18 Claims, No Drawings

RADIOGRAPHIC IMAGING ASSEMBLY WITH BLUE-SENSITIVE FILM

FIELD OF THE INVENTION

This invention is directed to radiography. In particular, it is directed to an imaging assembly comprised of a blue light-sensitive radiographic silver halide film and a blue-light emitting phosphor intensifying screen, which imaging assembly exhibits greater photographic speed. This invention also provides a method of radiographic imaging using this improved imaging assembly.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913. The discovery of X-rays in 1895 provided the beginning of a new way of providing medical evaluation and diagnosis. Prior to that time, medical examination comprised predominantly manual probing and consideration of symptoms. Such examinations would obviously be incomplete and inconclusive in most instances, and incorrect in some instances. In some cultures, there was a prohibition of touching the female anatomy, further limiting the effectiveness of medical examination. Thus, the discovery that X-radiation could pass through the body with relatively little harm and provide useful images provided a powerful tool in medical diagnosis and treatment.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and *Research Disclosure*, Vol. 184, August 1979, Item 18431.

Problem to be Solved

Some commercial radiographic films are sensitive to blue light and designed to be used in combination with blue-emitting fluorescent intensifying screens such as those containing calcium tungstate as the phosphor. Those films generally contain high silver coverage in the form of grains having cubic or other 3-dimensional morphology. The emulsion layers in those films are relatively "soft" meaning that relatively low levels of film hardener are used, in order to maximize covering power and to reduce drying time after processing with wet chemistries. However, the higher silver coverage contributed to longer processing times.

In addition, the silver halide emulsions in such films are generally "internally fogged" meaning that the emulsion grains have internal latent image sensitivity. Such emulsions, when coated in combination with high silver iodide emulsions sufficient to release iodide upon development to render the internally fogged emulsion developable, results in higher covering power than would be possible with the silver iodide emulsions. This property can provide the advantage of lower silver coverage and improved processing compared to higher silver-containing films, but it is also disadvantageous in that if the developer is contaminated with photographic fixers from the fixing tank, the internally fogged emulsion is developer prematurely and provided high fogging ($D_{min}$).

Blue-sensitive radiographic films are usually used in combination with one or more blue-emitting phosphor intensifying screens in cassettes or imaging assemblies. Various blue-emitting phosphor intensifying screens are known in the art and a number of them are commercially available as KODAK® X-Omatic Regular Screen (available from Eastman Kodak Company) and the Fuji High Plus Screen (available from Fuji Film Medical Systems). The most common phosphor used in known screens is calcium tungstate.

Thus, known radiographic imaging assemblies include the high silver blue-sensitive radiographic films and blue-emitting phosphor intensifying screens such as those containing calcium tungstate phosphors.

There is a desire in the industry to have radiographic imaging assemblies that include blue-sensitive radiographic films with reduced silver coverage and improved processability without significant loss of desired sensitometric properties. In addition, it is desired to provide higher speed from the radiographic imaging assemblies.

SUMMARY OF THE INVENTION

The present invention provides a radiographic imaging assembly comprising:

A. a blue-sensitive, radiographic silver halide film comprising a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains in the first silver halide emulsion layer are dispersed in a hydrophilic polymeric vehicle mixture comprising at least 0.5% of oxidized gelatin, based on the total dry weight of the polymeric vehicle mixture, and B. a first intensifying screen that comprises an inorganic phosphor capable of absorbing X-rays and emitting electromagnetic radiation having a wavelength of from about 300 to about 500 nm, the inorganic phosphor being coated in admixture with a polymeric binder in a phosphor layer onto a flexible support, the imaging assembly having a photographic speed of at least 300.

In preferred embodiments, a radiographic imaging assembly comprises:

A. a blue-sensitive, radiographic silver halide film comprising a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first and second silver halide emulsion layers having essentially the same composition and comprising predominantly tabular silver halide grains that have an aspect ratio of from about 20 to about 30, a grain thickness of from about 0.10 to about 0.14 $\mu$m, and comprising at least 95 mol % bromide and from about 1 to about 3.5 mol % iodide, based on total silver halide in each of the emulsion layers, substantially all of the iodide being present in an internal localized portion of the tabular silver halide grains that from about 1.7 to about 85% of the volume of the grains wherein 100% volume represents the surface of the grains, wherein the tabular silver halide grains in the first and second silver halide emulsion layers are dispersed in a hydrophilic polymeric vehicle mixture comprising from about 0.8% to about 1.2% of deionized oxidized gelatin, based on the total dry weight of the polymeric vehicle mixture, and B. first and second intensifying screens, each comprising an alkaline earth fluorohalide phosphor (such as a BaFBr:Eu phosphor) capable of absorbing X-rays and emitting electromagnetic radiation having a wavelength of from about 375 to about 425 nm, the alkaline earth fluorohalide phosphor being coated in admixture with a polyurethane binder in a phosphor layer onto a flexible polyester support and having a protective overcoat comprising a cellulose acetate disposed over the phosphor layer, the imaging assembly having a photographic speed of at least 350.

Further, this invention provides a method of providing a black-and-white image comprising exposing the radiographic imaging assembly of this invention, and processing the blue-sensitive radiographic silver halide film, sequentially, with a black-and-white developing composition and a fixing composition, the processing being carried out within 90 seconds, dry-to-dry.

The present invention provides a higher speed radiographic imaging assembly that includes a blue-sensitive, radiographic film with relatively lower silver coverage than known films and improved contrast and processability without loss in other sensitometric properties such as speed and maximum density. In addition, the images provided with this imaging assembly have improved sharpness and reduced "noise" (graininess).

These advantages are achieved by a combination of the specific blue-sensitive radiographic film and a specific intensifying screen containing a particular phosphor that emits light at a wavelength of from about 300 to about 500 nm, and especially an alkaline earth fluorohalide phosphor, more particularly a europium-doped barium fluorohalide phosphor.

The film emulsions contain high aspect tabular grains that have a thickness of at least 0.1 $\mu$m and include up to 4 mol % iodide based on total silver. This iodide is in localized portions of the grains that do not include the grain surface or the most internal nucleated portions of the grains. In addition, the coated tabular grains are dispersed in a hydrophilic polymeric binder mixture that includes at least 0.5 weight % of oxidized gelatin based on the total dry weight of the polymeric vehicle mixture. The emulsion formulation used to make the coated silver halide emulsion layer is similar in composition except that the level of oxidized gelatin is generally higher because additional polymer binders (such as non-oxidized gelatin) are usually added prior to coating. For example, the emulsion formulation can include at least 0.3 g of oxidized gelatin per mole of silver.

DETAILED DESCRIPTION OF THE INVENTION

Definition of Terms:

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is described as the instantaneous rate of change of a Density logE sensitometric curve or the instantaneous contrast at any logE value.

"Photographic speed" for the radiographic silver halide films used in this invention refers to the exposure necessary to obtain a density of at least 1.0 plus $D_{min}$ in the resulting black-and-white image.

"Photographic speed" for the radiographic imaging assembly of this invention refers to the percentage photicity relative to a conventional KODAK MinR fluorescent intensifying screen.

"Blue-sensitive" refers to sensitivity of the silver halide emulsion to a wavelength of from about 360 to about 540 nm, and preferably it refers to sensitivity to a wavelength of from about 380 to about 470 nm. Thus, "blue light-emitting" would refer to intensifying screens or phosphors that emit radiation at these wavelengths.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

In referring to grains and silver halide emulsions containing two or more halides, the halides are named in order of ascending molar concentrations.

The term "aspect ratio" is used to define the ratio of tabular grain diameter to grain thickness. The tabular diameter is calculated from a disc-centrifuge measurement and the grain thickness is determined from a reflectance measurement. Both measurements are performed using appropriate standards for calibration.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films used in the present invention are "dual-coated."

The term "fluorescent (or phosphor) intensifying screen" refers to an intensifying screen that absorbs X-radiation and emits light. A "prompt" emitting fluorescent intensifying screen will emit light immediately upon exposure to radiation while a "storage" fluorescent screen can "store" the exposing X-radiation for emission at a later time when the screen is irradiated with other radiation (usually visible light). The intensifying screens useful in the present invention emit light at a wavelength of from about 350 to about 450 nm and preferably at from about 375 to about 425 nm.

The terms "front" and "back" refer to layers, films, or phosphor intensifying screens nearer to and farther from, respectively, the source of X-radiation.

The term "rare earth" is used to indicate chemical elements having an atomic number of 39 or 57 through 71.

*Research Disclosure* is published by Kenneth Mason Publications, Ltd., Dudley House, 12 North St., Emsworth, Hampshire P010 7DQ England. It is also available from Emsworth Design Inc., 147 West 24th Street, New York, N.Y. 10011.

Radiographic Films:

The blue-sensitive radiographic silver halide films useful in the practice of this invention include a flexible support having disposed on both sides thereof, one or more photographic silver halide emulsion layers as described below and optionally one or more non-radiation sensitive hydrophilic layer(s). The silver halide emulsions in the various layers on both sides of the support can be the same or different.

In preferred embodiments, the photographic silver halide film has the same silver halide emulsion(s) on both sides of the support. It is also preferred that the film has a protective overcoat (described below) over the silver halide emulsions on each side of the support.

The support can take the form of any conventional radiographic film support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with one silver halide emulsion layer on each side of the film support. This layer may be called an interlayer or overcoat, or both.

Each side of the support comprises one or more silver halide emulsion layers. On at least one of those sides (and preferably on both sides), at least one silver halide emulsion that contain predominantly tabular silver halide grains (that is, more than 60 weight % of all grains and preferably at least 80 weight %) having an average aspect ratio greater than 15. Preferably, these grains have an aspect ratio of from about 20 to about 30. The optimal aspect ratio may be dependent upon the particular mol % of iodide present in the grains.

The average thickness of these tabular grains is at least 0.1 $\mu$m with an upper limit of 0.15 $\mu$m, and preferably the tabular grain thickness is from about 0.10 to about 0.14 $\mu$m.

These tabular silver halide grains particularly include predominantly (at least 90 mol %) bromide, preferably at least 95 mol % bromide, and more preferably at least 97 mol % bromide, based on total silver in the emulsion layer. In addition, these tabular grains have up to 4 mol % iodide, and preferably up to 3.5 mol % iodide, based on total silver in the emulsion layer. Preferably, the iodide content is at least 1 mol % and preferably at least 2 mol %, based on total silver in the emulsion layer. The tabular silver halide grains in each silver halide emulsion unit (or silver halide emulsion layers) can be the same or different, and there can be mixtures of tabular grains in an emulsion layer having different halide composition and aspect ratio as long as the conditions noted above are still met.

The silver halide emulsion layers on the opposing sides of the support are identified herein as "first" and "second" silver halide emulsion layers with the "first" layer being disposed on the side of the film that is exposed first. Preferably, these "first" and "second" silver halide emulsion layers have the same composition (for example, type of grains, grain halide composition, silver coverage, and hydrophilic polymeric vehicle mixture).

Thus, either or both of the first and second silver halide emulsion layers can have the same or different composition and comprise predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains in the first and/or second silver halide emulsion layers are dispersed in a hydrophilic polymeric vehicle mixture comprising at least 0.5% of oxidized gelatin, based on the total dry weight of the polymeric vehicle mixture in the first and/or second emulsion layers.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The iodide present in the tabular silver halide grains described above is substantially all located in an "internal localized portion" of the grains. This means that substantially none of the iodide is present on the surfaces of the grains. This feature can be defined by the volume % of a grain wherein 0 volume % refers to the center of the grain and 100 volume % refers to the grain surface. In the present invention, the iodide is present in an internal localized portion at from about 1.5% to about 90 volume %. Preferably, the "beginning" of the internal localized portion is from about 1.5% to about 10 volume % and the "ending" of the internal localized portion is from about 65% to about 90 volume %. Thus, the nucleated internal portion of the grains contains no iodide. More preferably, the iodide is uniformly distributed throughout the internal localized portion represented by from about 1.7 to about 85 volume %.

This localization of the iodide within the tabular grains can be achieved using known procedures whereby preparation of the tabular grains is begun (nucleation and initial growth) without the presence of iodide. Then iodide is introduced during a predetermined portion of the manufacturing method until the desired volume % includes iodide and manufacture of the grains is continued without iodide. A representative preparation is provided in the following paragraphs. Other details for making tabular grains in a similar manner are provided in U.S. Pat. No. 4,665,012 (Sugimoto et al.), incorporated herein by reference.

In general, the tabular silver halide grains useful in the practice of this invention can be prepared using a silver bromide-grain nucleation (and early growth) in a "bromide ion concentration free-fall" process with slow silver ion addition into a bromide ion-rich deionized oxidized gelatin environment. The number of grains having tabular morphology is enhanced using a brief period of silver solvent-enhanced digestion. After digestion, additional gelatin of any type (preferably oxidized gelatin and more preferably deionized oxidized gelatin) can be added. Further grain growth is then carried out by controlling the silver ion concentration in a halide-rich environment, using either bromide or iodobromide growth/control salts as required. Following grain growth, after washing out salts remaining in the solution phase of the emulsion, the emulsion is further peptized using a non-oxidized gelatin (preferably, deionized, non-oxidized gelatin).

The silver halide emulsions described herein can have some non-tabular silver halide grains as long as they represent less than 40 weight % of the total grains in a given silver halide emulsion layer. Such grains can have any desirable morphology including, but not limited to, octahedral, tetradecahedral, rounded, spherical or other non-tabular or singularly-twinned or multiply-non-parallel twinned morphologies, or be comprised of a mixture of two or more of such morphologies.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 38957, cited above, Section 1. Emulsion grains and their preparation, subsection D. Grain modifying conditions and adjustments, paragraphs (3), (4), and (5).

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

The silver halide emulsions include one or more suitable spectral sensitizing dyes to provide the desired blue-light sensitivity. Useful classes of spectral sensitizing dyes include, for example monomethine cyanine dyes, that are derived from substituted benzoxazole, benzothiazole, benzoselenazole, or benzimidazole compounds, or combinations thereof, including the dyes described in U.S. Pat. No. 4,518,689 (Noguchi et al.), incorporated herein by reference. Other details about such compounds are provided by Hamer, *The Cyanine Dyes and Related Compounds*, Interscience, New York, 1964. The useful amounts of such dyes are well known in the art but are generally from about 0.2 to about 2 mmol/mole of silver in the emulsion layer, and preferably from about 0.5 to about 1 mmol/mole of silver in the emulsion layer.

Useful cyanine spectral sensitizing dyes can be represented by the following Structure SS and preferred spectral sensitizing dyes are identified in the Example below as SS-1 and SS-2:

(SS)

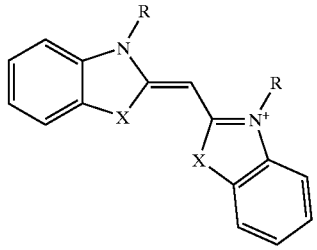

wherein the "R" groups can be the same or different, X is thio, oxy, seleno, imino, and the aromatic rings can be further substituted if desired.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the radiographic films generally contain conventional polymer vehicles (peptizers and binders) that include both synthetically prepared and naturally occurring colloids or polymers. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone.

Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

It is essential that the coated tabular grain silver halide emulsion layers on one or both sides of the support comprise tabular silver halide grains dispersed in a hydrophilic polymeric vehicle mixture comprising at least 0.5% and preferably at least 0.8% of oxidized gelatin based on the total weight of polymeric vehicle mixture in that coated emulsion layer. The upper limit of the oxidized gelatin is not critical but for practical purposes, it is 1.5% based on the total weight of the polymer vehicle mixture. Preferably, from about 0.8 to about 1.2% (by weight) of the polymer vehicle mixture is oxidized gelatin.

It is also preferred that the oxidized gelatin be in the form of deionized oxidized gelatin but non-deionized oxidized gelatin can be used, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 $\mu$mol of methionine, and more preferably from 0 to 1 $\mu$mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic films are generally fully hardened using one or more conventional hardeners. Thus, the amount of hardener in each silver halide emulsion and other hydrophilic layer is generally at least 0.6% and preferably at least 0.7%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, $\alpha$-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide films useful in the present invention are as follows. In general, the total amount of silver on each side of the support is at least 17 and no more than 21 mg/dm2 in one or more emulsion layers. Preferably, the amount of silver on each side of the support is from about 17 to about 19 mg/dm$^2$. In addition, the total amount of polymer vehicle on each side of the support is generally at least 22 and no more than 30 mg/dm$^2$ in one or more hydrophilic layers. The amounts of silver and polymer vehicle on the two sides of the support in the radiographic silver halide film can be the same or different. These amounts refer to dry weights.

The radiographic silver halide films useful in this invention generally include a surface protective overcoat on each side of the support that typically provides physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film.

The various coated layers of radiographic silver halide films can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Imaging Assemblies:

The radiographic imaging assemblies of the present invention comprise a blue-sensitive, radiographic silver halide film described herein and one or more blue-light emitting fluorescent intensifying screens that absorb X-radiation and emit radiation having a maximum absorption at from about 350 to about 450 nm (preferably from about 375 to about 425 nm). These screens can take any convenient form providing they meet all of the usual requirements for use in radiographic imaging. Examples of conventional intensifying screens constructions and methods of making them are provided by *Research Disclosure*, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains specific phosphor particles (described below) and a binder, optimally additionally containing a light scattering material, such as titania or light absorbing materials such as particulate carbon, dyes or pigments, to form a phosphor layer that is disposed in a suitable manner on a suitable support. Any conventional binder (or mixture thereof) can be used but preferably the binder is an aliphatic polyurethane elastomer or another highly transparent elastomeric polymer.

Any useful phosphor that provides stimulated emission at the desired wavelength can be used in the practice of this invention. Examples of such phosphors are described, for example, in U.S. Pat. No. 4,835,397 (Arakawa et al., Columns 6–9), U.S. Pat. No. 5,381,015 (Dooms), and U.S. Pat. No. 5,464,568 (Bringley et al.), all incorporated herein by reference. Particularly useful phosphors include the alkaline earth fluorohalide phosphors and especially the rare earth activated (doped) alkaline earth fluorohalide phosphors. The europium activated barium fluorohalide phosphors are most preferred.

The fluorescent intensifying screens useful in this invention, in combination with the radiographic films described herein, provide an imaging assembly having photographic speeds of at least 300 and preferably at least 350. The contribution of the screen to the photographic speed can be adjusted by modification of phosphor, phosphor particle size, and phosphor coverage. For example, at least 50% of the particles have a size of less than 12 $\mu$m. In addition, the coverage of phosphor in the dried layer is from about 20 to about 80 g/m$^2$, and preferably from about 30 to about 50 g/m$^2$.

Flexible support materials for radiographic intensifying screens in accordance with the present invention include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or similar materials. A plastic film is preferably employed as the support material.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity type radiographic screen.

These supports may have a thickness that may differ depending on the material of the support, and may generally be between 60 and 1000 $\mu$m, more preferably between 80 and 500 $\mu$m from the standpoint of handling.

As is also known in the art, the intensifying screens can have a protective overcoat disposed over the phosphor layer. Such overcoats include one or more film-forming binder materials such as cellulose acetate, poly(methyl methacrylate), poly(vinyl butyral), and polycarbonates. Cellulose acetate is preferred.

While a single intensifying screen can be used in the practice of this invention, preferably at least two intensifying screens are used in the radiographic imaging assembly, and the two screens can have the same or different construction and composition as long as they are both blue-light emitting. Preferably, the two screens have the same construction and composition, such as the same rare earth activated barium fluorohalide phosphor.

Image Formation:

Exposure and processing of the radiographic silver halide films described herein can be undertaken in any convenient conventional manner. The exposure and processing techniques of U.S. Pat. No. 5,021,327 (Bunch et al.) and U.S. Pat. No. 5,576,156 (Dickerson) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

It is particularly desirable that the radiographic silver halide films be processed within 90 seconds ("dry-to-dry") and preferably within 60 seconds (for at least 20 seconds), for the developing, fixing, any washing (or rinsing) and drying steps. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al.) and EP 0 248,390A1 (Akio et al.).

The following example is presented for illustration and the invention is not to be interpreted as limited thereby.

EXAMPLE 1

Radiographic Film A (Invention)

The radiographic film was a dual-coated film having the same silver halide emulsion, interlayer, and overcoat layer on each side of a blue-tinted 178 $\mu$m transparent poly (ethylene terephthalate) film support. Specifically, the emulsion disposed on each side of the support contained deionized oxidized gelatin that had been added at multiple times before and/or during the nucleation and early growth of the silver iodobromide tabular grains dispersed therein. The grains had a mean aspect ratio of about 22.5. The nucleation and early growth of the tabular grains were performed using a "bromide-ion-concentration free-fall" process in which a dilute silver nitrate solution was slowly added to a bromide-rich deionized oxidized gelatin environment. The iodide was added during grain growth as an Ag-controlling iodobromide salt containing 3.5 mol % iodide, starting after the beginning of growth (at 1.7% of the final grain volume) and ending at 85% of the final grain volume. This provided iodide in a localized portion of the grains of 1.7 to 85% where 100% refers to the grain surface. Between 85% and 100% of the grain volume of the grains was comprised of silver bromide only. The grains were chemically sensitized with aurousdithiosulfate, sodium thiocyanate, and potassium selenocyanate using conventional procedures. Spectral sensitization to the 420–480 nm region was provided using a 50:50 molar blend of SS-1 and SS-2 identified below. The total amount of spectral sensitizing dyes was 500 mg per mole of silver.

The film had the following layer arrangement:

Overcoat
Interlayer
Emulsion Layer
Support
Emulsion Layer
Interlayer
Overcoat

The noted layers were prepared from the following formulations.

| | Coverage ($mg/dm^2$) |
|---|---|
| Overcoat Formulation | |
| Gelatin vehicle | 3.4 |
| Methyl methacrylate matte beads | 0.28 |
| Carboxymethyl casein | 0.73 |
| Colloidal silica (LUDOX AM) | 1.06 |
| Polyacrylamide | 0.53 |
| Chrome alum | 0.025 |
| Resorcinol | 0.058 |
| Spermafol lubricant | 0.035 |
| TRITON ® X-200 E surfactant | 0.21 |
| LODYNE S-100 surfactant | 0.0015 |
| PLURONIC ® L43 surfactant | 0.0029 |
| Cysteine glutaraldehyde | $1.42 \times 10^{-5}$ |
| Interlayer Formulation | |
| Gelatin vehicle | 3.4 |
| Carboxymethyl casein | 0.73 |
| Colloidal silica (LUDOX AM) | 1.06 |
| Polyacrylamide | 0.53 |
| Chrome alum | 0.25 |
| Resorcinol | 0.058 |
| PLURONIC ® L43 surfactant | 0.0029 |
| Cysteine glutaraldehyde | $1 \times 10^{-5}$ |
| Emulsion Layer Formulation | |
| Tabular grain emulsion [AgIBr (3:97 mol ratio, 2.7 × 0.12 μm average diameter and thickness] | 18.7 |
| Gelatin vehicle | 20.5 |
| 4-Hydroxy-6-methyl-1,3,3a,7-tetraazaindene | 2.1 g/Ag mole |
| Nitroindazole | 84.5 g/Ag mole |
| Potassium nitrate | 3.81 |
| Sodium disulfocathecol | 4.69 g/Ag mole |
| Maleic acid hydrazide | 1.31 |
| Sorbitol | 1.26 |
| Glycerin | 2.02 |
| Dextran P | 5.4 |
| Carboxymethylcasein | 1.62 |
| Polyacrylamide | 2.7 |
| Chrome alum | 13.3 g/Ag mole |
| Bisvinylsulfonylmethane | 1% based on total gelatin in all layers on each side |

-continued

| | Coverage ($mg/dm^2$) |
|---|---|

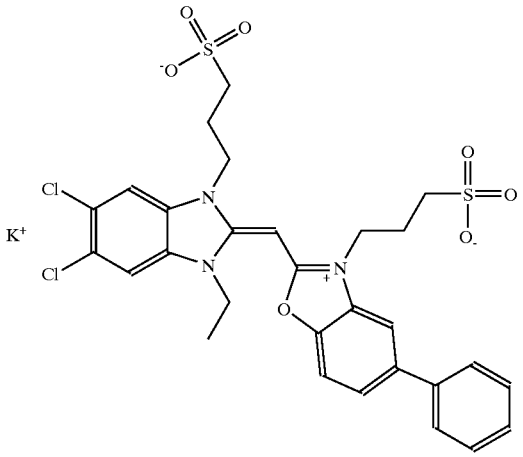

(SS-1)

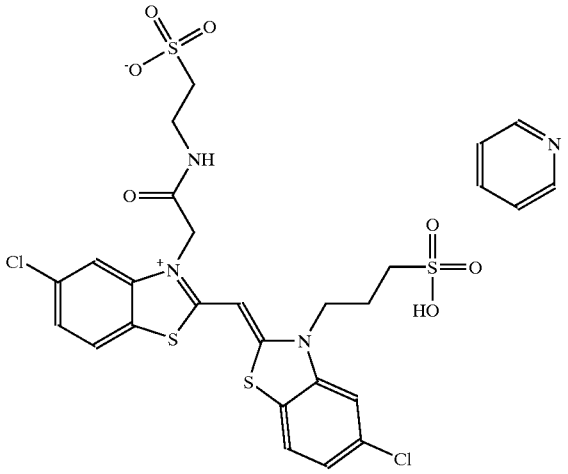

(SS-2)

Samples of the film were exposed using a pair of each of the three screens described below using a Phillips Hi-frequency X-ray generator, a 42-inch (106.7 cm) film focal distance at 80 kVP, a 2.56 mm aluminum filter, and an inverse square X-ray sensitometer. A lead screw moves the detector between exposures. By use of the inverse square law, distances are selected to produce exposures that differ by 0.100 logE. The length of the exposures was a constant. With this instrument, we could obtain sensitometry that gives the response of the detector to the imagewise exposure. The image is therefore exposed for the same length of time but the intensity changes due to the anatomy transmitting more or less of the X-ray flux.

Intensifying screens evaluated in this example were:

Screen X (Control A)

Commercially available Kodak X-Omatic Regular screen that includes europium-activated barium strontium sulfate as the phosphor.

Screen Y (Control B)

Commercially available Fuji High Plus Screen that includes calcium tungstate as the phosphor.

Screen Z (Invention)

This intensifying screen comprised BaFBr:Eu phosphor (432 g/m$^2$, 6 $\mu$m average particle size) in a polyurethane binder (Permuthane U6366 from Stahl Corp., 20.6 g/m$^2$) to provide a phosphor layer disposed on a poly(ethylene terephthalate) film support. The weight ratio of phosphor to binder was 21:1 and phosphor layer included 17 ppm carbon. The phosphor layer was overcoated with a protective layer comprising cellulose acetate (10 g/m$^2$).

The film samples were processed using a processor commercially available under the trademark KODAK RP X-OMAT™ film Processor 5000RA. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were developed in each instance for less than 25 seconds. Fixing was carried out using KODAK RP X-OMAT™ LO Fixer and Replenisher fixing composition (Eastman Kodak Company). Overall processing (dry-to-dry) was carried out within 90 seconds.

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. logE curve was plotted for each radiographic film that was imaged and processed. Speed of the combination of radiographic film and intensifying screen was measured at a density of 1.4+ $D_{min}$. The speed values are relative to the imaging assembly with Film A and Screen X set at "200". Gamma (contrast) is the slope (derivative) of the noted curves.

"Sharpness" (contrast) was determined by a visual subjective evaluation of phantom images and given a rating of 1 to 3 with th e lower number referring to greater sharpness.

The following TABLE I shows the sensitometric properties of the film-screen imaging assemblies. It is apparent from the data that higher contrast (improved sharpness) and photographic speed were achieved using the imaging assembly of the present invention (Film with Screen Z).

TABLE I

| Film | Screen | Relative Speed | Sharpness |
|---|---|---|---|
| A | X (Control) | 200 | 3 |
| A | Y (Control) | 269 | 2 |
| A | Z (Invention) | 367 | 1 |

EXAMPLE 2

Imaging assemblies like those described in Example 1 (with Film A) were used to image a "knee phantom" and the sensitometric properties were determined as described in Example 1. The imaging conditions and results are provided in the following TABLE II. It is apparent that the imaging assembly of the present invention provided increased photographic speed and sharpness.

TABLE II

| Screen | mA | ms | mR | mA/mR | Density | Relative Speed | Sharpness |
|---|---|---|---|---|---|---|---|
| X | 79 | 25 | 11.350 | 6.960 | 1.591 | 200 | 3 |
| Y | 58 | 25 | 8.000 | 7.250 | 1.605 | 287 | 2 |
| Z | 46 | 25 | 6.120 | 7.516 | 1.583 | 369 | 1 |

The invention has been described in detail with particular reference to preferred embodiments thereof, but it will be understood that variations and modifications can be effected within the spirit and scope of the invention.

We claim:

1. A radiographic imaging assembly comprising:

A) blue-sensitive radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of said iodide being present in an internal localized portion of said tabular silver halide grains that excludes the surface of said grains, wherein said tabular silver halide grains in said first silver halide emulsion layer are dispersed in a hydrophilic polymeric vehicle mixture comprising at least 0.5% of oxidized gelatin, based on the total dry weight of said polymeric vehicle mixture, and B) a first intensifying screen that comprises an inorganic phosphor capable of absorbing X-rays and emitting electromagnetic radiation having a wavelength of from about 300 to about 500 nm, said inorganic phosphor being coated in admixture with a polymeric binder in a phosphor layer onto a flexible support, said imaging assembly having a photographic speed of at least 300.

2. The radiographic imaging assembly of claim 1 wherein said tabular silver halide grains in said first silver halide emulsion layer comprise at least 90% of the total silver halide grains and said tabular silver halide grains comprise at least 95 mol % bromide and up to 3.5 mol % iodide based on total silver halide in said first silver halide emulsion layer.

3. The radiographic imaging assembly of claim 1 wherein said second silver halide emulsion layer comprises predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of said iodide being present in an internal localized portion of said tabular silver halide grains that excludes the surface of said grains, wherein said tabular silver halide grains in said second silver halide emulsion layer are dispersed in a hydrophilic polymeric vehicle mixture comprising at least 0.5% of oxidized gelatin, based on the total dry weight of said polymeric vehicle mixture.

4. The radiographic imaging assembly of claim 1 wherein said first and second silver halide emulsion layers have essentially the same composition.

5. The radiographic imaging assembly of claim 1 wherein said tabular silver halide grains in said first silver halide emulsion layer comprise iodide in a localized portion of said grains that is from about 1.5 to about 90 volume % of said grains wherein 100% volume represents the surface of said grains.

6. The radiographic imaging assembly of claim 1 wherein said tabular silver halide grains of said first silver halide emulsion layer comprise from about 1 to about 3.5 mol % iodide, based on total silver halide in said first silver halide emulsion layer.

7. The radiographic imaging assembly of claim 1 comprising polymer vehicles on each side of said support in a total amount of from about 22 to about 30 mg/dm$^2$ and a level of silver on each side of said support of from about 17 to about 21 mg/dm$^2$.

8. The radiographic imaging assembly of claim 1 wherein the level of silver on each side of said support of from about 17 to about 19 mg/dm$^2$.

9. The radiographic imaging assembly of claim 1 wherein said inorganic phosphor is an inorganic alkaline earth fluorohalide phosphor that emits radiation at a wavelength of from about 350 to about 450 nm.

10. The radiographic imaging assembly of claim 9 wherein said inorganic phosphor is a barium fluorohalide phosphor that emits radiation at a wavelength of from about 375 to about 425 nm.

11. The radiographic imaging assembly of claim 1 further comprising a second intensifying screen that comprises an inorganic phosphor capable of absorbing X-rays and emitting electromagnetic radiation having a wavelength of from about 300 to about 500 nm, said inorganic phosphor being coated in admixture with a polymeric binder in a phosphor layer onto a flexible support.

12. The radiographic imaging assembly of claim 11 wherein said first and second intensifying screens have the same construction and composition.

13. A radiographic imaging assembly comprising:

A) a blue-sensitive radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first and second silver halide emulsion layers having essentially the same composition and comprising predominantly tabular silver halide grains that have an aspect ratio of from about 20 to about 30, a grain thickness of from about 0.10 to about 0.14 $\mu$m, and comprising at least 95 mol % bromide and from about 1 to about 3.5 mol % iodide, based on total silver halide in said emulsion layers, substantially all of said iodide being present in an internal localized portion of said tabular silver halide grains that from about 1.7 to about 85 volume % of said grains wherein 100% volume represents the surface of said grains, wherein said tabular silver halide grains in said first and second silver halide emulsion layers are dispersed in a hydrophilic polymeric vehicle mixture comprising from about 0.8% to about 1.2% of deionized oxidized gelatin, based on the total dry weight of said polymeric vehicle mixture, and B) first and second intensifying screens, each comprising a BaFBr:Eu phosphor capable of absorbing X-rays and emitting electromagnetic radiation having a wavelength of from about 375 to about 425 nm, said BaFBr:Eu phosphor being coated in admixture with a polyurethane binder in a phosphor layer onto a flexible polyester support and having a protective overcoat comprising a cellulose acetate disposed over said phosphor layer, said imaging assembly having a photographic speed of at least 350.

14. The imaging assembly of claim 13 wherein said first and second intensifying screens have the same construction and composition.

15. The radiographic imaging assembly of claim 13 wherein said blue-sensitive radiographic silver halide film further comprises a protective layer over each of said first and second silver halide emulsion layers.

16. A method of providing a black-and-white image comprising exposing the radiographic imaging assembly of claim 1, and processing said blue-sensitive radiographic silver halide film, sequentially, with a black-and-white developing composition and a fixing composition, said processing being carried out within 90 seconds, dry-to-dry.

17. The method of claim 16 wherein said processing is carried out for 60 seconds or less.

18. A method of providing a black-and-white image comprising exposing the radiographic imaging assembly of claim 13, and processing said blue-sensitive radiographic silver halide film, sequentially, with a black-and-white developing composition and a fixing composition, said processing being carried out within 90 seconds, dry-to-dry.

* * * * *